US009723884B2

(12) United States Patent
Takani

(10) Patent No.: US 9,723,884 B2
(45) Date of Patent: Aug. 8, 2017

(54) SLIDER FOR SLIDE FASTENER

(71) Applicant: YKK Corporation, Tokyo (JP)

(72) Inventor: Go Takani, Toyama (JP)

(73) Assignee: YKK Corporation (JP)

( * ) Notice: Subject to any disclaimer, the term of this patent is extended or adjusted under 35 U.S.C. 154(b) by 69 days.

(21) Appl. No.: 14/514,749

(22) Filed: Oct. 15, 2014

(65) Prior Publication Data

US 2015/0101155 A1 Apr. 16, 2015
US 2017/0172241 A9 Jun. 22, 2017

(30) Foreign Application Priority Data

Oct. 16, 2013 (CN) ..... 2013 2 0642615 U

(51) Int. Cl.
*A41F 1/00* (2006.01)
*A44B 19/26* (2006.01)
*A44B 18/00* (2006.01)

(52) U.S. Cl.
CPC ..... *A41F 1/008* (2013.01); *A44B 19/26* (2013.01); *A44B 19/262* (2013.01); *A44B 19/265* (2013.01); *A44B 18/00* (2013.01); *A44B 18/0023* (2013.01); *Y10T 24/2582* (2015.01); *Y10T 24/2586* (2015.01); *Y10T 24/2589* (2015.01)

(58) Field of Classification Search
CPC ..... Y10T 24/2586; Y10T 24/2582; Y10T 24/2589; Y10T 24/2561; A41F 1/008; A44B 19/265; A44B 19/26; A44B 19/262
USPC ..... D11/221
See application file for complete search history.

(56) References Cited

U.S. PATENT DOCUMENTS 2,133,482 A * 10/1938 Scuderi ..... A44B 11/003 24/163 FC
2,644,776 A * 7/1953 Williams ..... A44B 11/003 24/163 FC
2,654,927 A * 10/1953 Tansman ..... A44B 1/123 24/113 R
4,941,234 A * 7/1990 Watanabe ..... A44B 1/08 24/113 MP
5,007,144 A * 4/1991 Terada ..... A44B 19/26 24/415

FOREIGN PATENT DOCUMENTS

JP S44-013524 Y 6/1969
JP S48-030003 Y 4/1973
JP H7-021124 Y 5/1995
WO 2012-129382 A1 9/2012

* cited by examiner

*Primary Examiner* — Robert J Sandy
(74) *Attorney, Agent, or Firm* — Kilpatrick Townsend & Stockton LLP

(57) ABSTRACT

There is provided a slider for a slide fastener. A slider body includes an upper blade disposed at a front side of the slider body, which is a pull-tab attachment side, a lower blade disposed at a back side of the slider body, which is opposite to the front side, and a connecting post connecting the upper blade and the lower blade to each other. A fibrous fabric sheet is integrally fixed to a back surface of the lower blade at the back side, with an adhesive layer being interposed between the fibrous fabric sheet and the back surface of the lower blade.

8 Claims, 5 Drawing Sheets

SLIDER FOR SLIDE FASTENER

The present application claims priority to Chinese Patent Application No. 201320642615.5 U, filed on Oct. 16, 2013 and entitled "Slider for Slide Fastener," the entire contents of which are hereby incorporated by reference.

TECHNICAL FIELD

The present invention relates to a slider for a slide fastener, and more particularly, to a slider for a slide fastener to be attached to a jacket for use in cold regions, the slider having the function of preventing cold feeling.

BACKGROUND

In a case where a slider for a slide fastener to be attached to a jacket such as a ski suit for use in cold regions is made of metal, when the slider directly touches the skin (e.g. the neck, a shoulder or the chin) of a user in a cold atmosphere, the user has cold feeling and feels uncomfortable. As a countermeasure, the slider is subjected to cold feeling preventive treatment to have the function of preventing cold feeling.

For instance, Patent Document 1 discloses a configuration for imparting the function of reducing cold feeling to a metal fastener slider. Specifically, a cover is attached to a lower blade of a slider body, and a space is defined between the lower surface of the lower blade and the plane of the cover. Since air having high heat insulation property is sealed inside this space, direct transfer of the low temperature of the slider body to the skin is prevented or slowed down.

In addition, Patent Document 2 discloses attaching extremely short fibers of, for example, silk, hair, cotton or synthetic fiber, to the entire surface of a slider body by electro-deposition fiber implantation or using an adhesive in order to improve decorative properties. Although this slider is not dedicated to reduce cold feeling, its function of reducing cold feeling is effective to a certain level.

Although the slider having the function of reducing cold feeling disclosed in Patent Document 1 above can realize the effect of preventing or slowing down the direct transfer of the low temperature of the slider body to the skin, the effect of reducing cold feeling may significantly decrease when a long time has passed. In addition, since the cover is attached to the slider, it is required to form an engaging portion for fixing the cover to the slider body, thereby making it difficult to suppress fabrication time, cost, or the like. In addition, the major component of the cover material is a resin material, which gives cold feeling in extremely cold regions or the like.

Although the slider disclosed in Patent Document 2 can realize the function of reducing cold feeling in a certain level, when the jacket with the slider attached thereto is washed several times, the short fibers attached to the slider are stripped off, thereby causing the problem of insufficient durability.

Patent Document 1: Japanese Utility Model Publication No. H07-21124

Patent Document 2: Japanese Utility Model Publication No. S44-13524

SUMMARY

It is therefore an object of the present invention to provide a slider for a slide fastener which rarely gives cold feeling even when the back surface of the slider for the slide fastener touches the skin (in particular, the neck, a shoulder, the chin, or the like) of a person in the case in which, for example, a jacket with the slide fastener attached thereto is used for a long time in cold regions. In addition, the slider has high durability and is fabricated at a low cost.

In order to achieve the above object, according to an aspect of the embodiments of the present invention, there is provided a slide for a slide fastener comprising a slider body which includes: an upper blade disposed at a front side of the slider body, which is a pull-tab attachment side; a lower blade disposed at a back side of the slider body, which is opposite to the front side; and a connecting post connecting the upper blade and the lower blade to each other, wherein a fibrous fabric sheet is integrally fixed to a back surface of the lower blade at the back side, with an adhesive layer being interposed between the fibrous fabric sheet and the back surface of the lower blade.

According to the above configuration, it is possible to impart the function of preventing cold feeling to existing sliders at a low cost without adapting the slider body to a special shape.

In addition, since a member for preventing cold feeling is the fibrous fabric sheet, the member does not become cold even after the elapse of a long time. Therefore, when the member partially touches the skin of the neck or the like, the member rarely gives cold feeling.

Furthermore, since the fibrous fabric sheet is a sheet-shaped article, the fibrous fabric sheet is not easily released from the slider body, thereby obtaining high durability.

In the slider, a circumferential portion of the back surface of the lower blade may be exposed without being covered with the fibrous fabric sheet.

According to the above configuration, since the fibrous fabric sheet is not present at least on the circumference of the back surface of the slider body, it is possible to reduce the possibility that the fibrous fabric sheet may be stripped off from the end portion thereof, thereby improving the durability of the slider with the function of preventing cold feeling.

In the slider, the back surface of the lower blade may comprise a chamfered portion at a circumferential portion thereof, the chamfered portion being curved or inclined so as to come close to the upper blade toward the outside of the slider body, and a flat surface surrounded by the chamfered portion, and the fibrous fabric sheet may be fixed to the flat surface.

According to the above configuration, since the circumferential edge portion of the fibrous fabric sheet does not extend outward beyond the circumference of the back surface of the lower blade, it is possible to reduce the possibility that the fibrous fabric sheet may be stripped off from the end portion thereof, thereby improving the durability of the slider with the function of preventing cold feeling.

In addition, since the circumferential portion of the back surface of the lower blade is chamfered such that the circumferential portion is curved or inclined toward the upper blade, the circumferential portion of the lower blade rarely touches the neck or the like. This consequently lowers the possibility that the circumferential portion may touch the skin and give cold feeling to the skin.

In the slider, the fibrous fabric sheet may not protrude toward the outside of the slider body beyond the adhesive layer.

According to the above configuration, it is possible to prevent the fibrous fabric sheet from being stripped off from the end portion while strongly bonding the fibrous fabric sheet to the slider body.

In the slider, the adhesive layer may be formed of an adhesive or an adhesive sheet, and the adhesive may be an epoxy-based adhesive.

According to the above configuration, the adhesive layer may be formed of a liquid adhesive or a sheet-shaped adhesive. In addition, the adhesive may be implemented as an epoxy-based adhesive. Since the epoxy-based adhesive has strong bonding force and can withstand low temperature, the fibrous fabric sheet and the slider body can be strongly bonded to each other.

In the slider, the adhesive may fix the fibrous fabric sheet by penetrating between fibers of the fibrous fabric sheet from a first surface of the fibrous fabric sheet, which faces the adhesive layer.

According to the above configuration, since some of the fibers exposed on the first surface of the fibrous fabric sheet, that faces the adhesive layer are buried in the adhesive, the fibrous fabric sheet and the slider body can be strongly bonded to each other.

In the slider, the adhesive may not exude from a second surface of the fibrous fabric sheet, which is opposite to the first surface of the fibrous fabric sheet, which faces the adhesive layer.

According to the above configuration, since the adhesive is not exposed on the side of the fibrous fabric sheet, that may touch the skin, when a user is wearing a jacket to which the slider according to the embodiment of the present invention is applied, the adhesive does not touch the skin of the neck or the like while the slider touches the neck or the like. It is therefore possible to maintain high cold feeling prevention effect without decreasing soft feeling while strongly bonding the fibrous fabric sheet and the slider body to each other.

According to the present invention, it is possible to provide the slider for a slide fastener which rarely gives cold feeling when the back surface of the slider for the slide fastener touches the skin of the person, such as the neck, a shoulder, or the chin in a case in which, for example, a jacket with the slide fastener attached thereto is used for a long time in cold regions. In addition, the slider has high durability and is fabricated at a low cost.

DETAILED DESCRIPTION OF THE EMBODIMENTS

Hereinafter, embodiments of the present invention will be described in detail with reference to FIG. 1 to FIG. 5.

Figure 1:
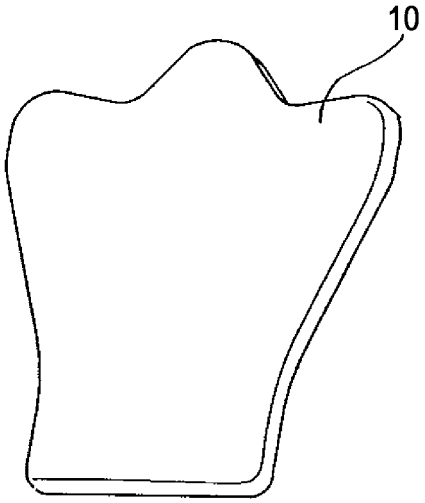
FIG. 1 is an exploded perspective view schematically illustrating a slider body and a fibrous fabric sheet of a slider for a slide fastener according to an embodiment of the present invention.
Figure 1:
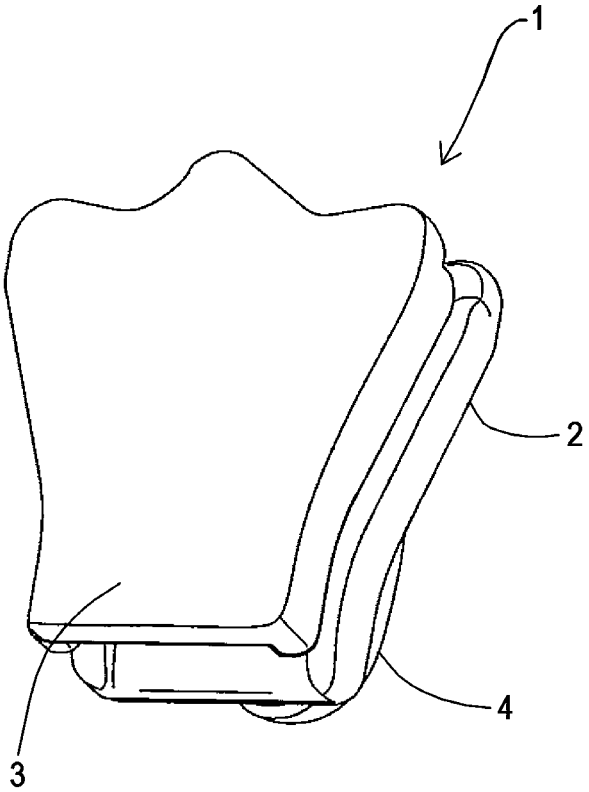
Figure 2:
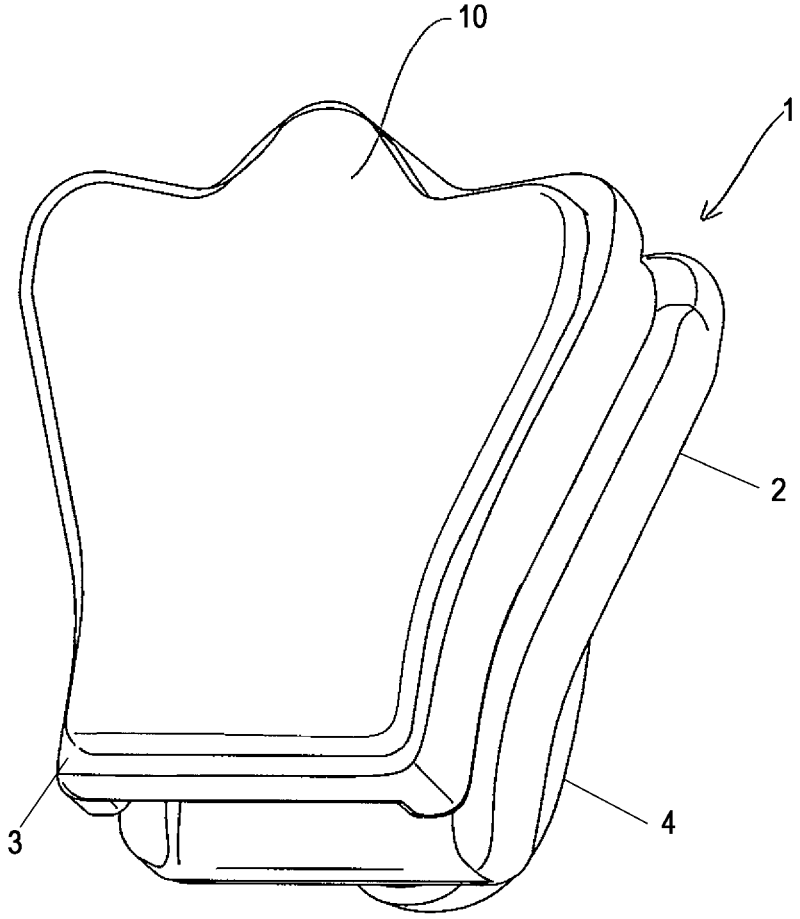
FIG. 2 is a perspective view schematically illustrating the state of the slider for the slide fastener according to the embodiment of the present invention in which the fibrous fabric sheet is bonded to the slider body.
Figure 3:
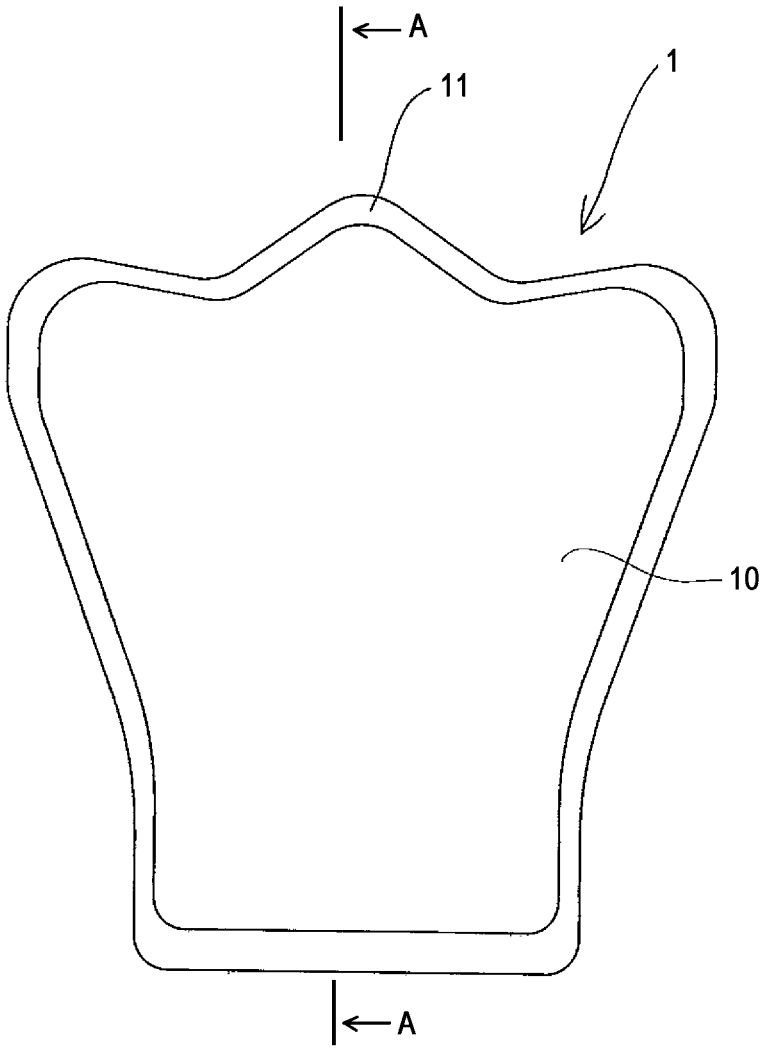
FIG. 3 is a rear view of the slider for the slide fastener according to the embodiment of the present invention, for illustrating the back surface of the slider.
Figure 4:
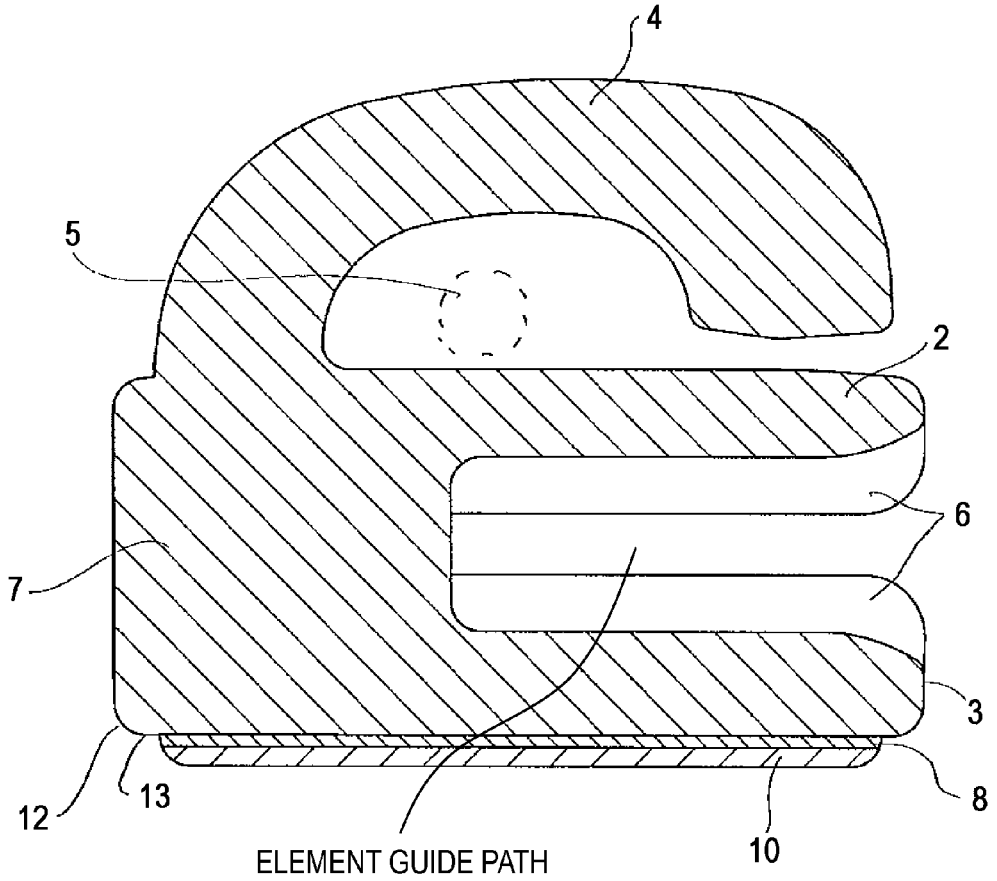
FIG. 4 is a cross-sectional view taken along line A-A in FIG. 3.
Figure 5:
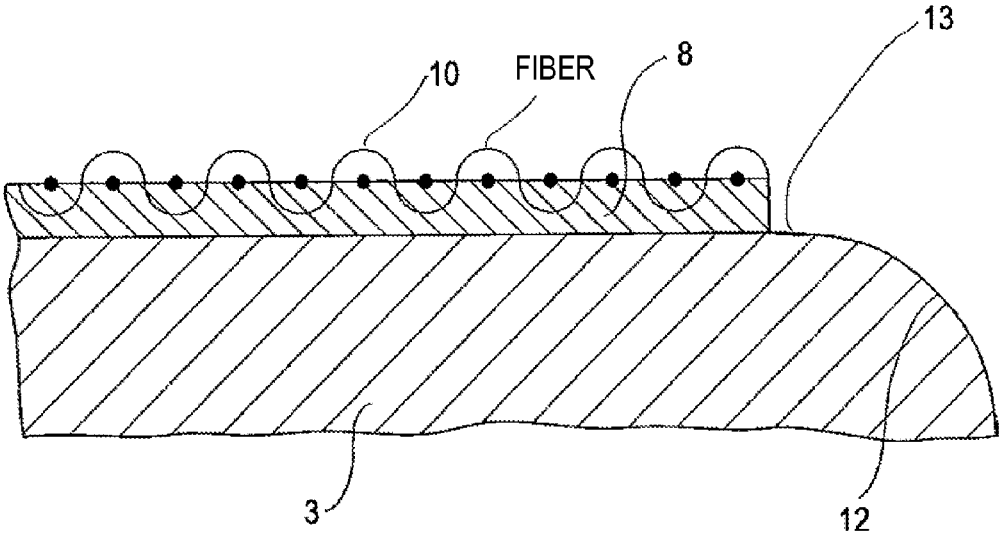
FIG. 5 is a partially expanded cross-sectional view schematically illustrating the state in which the fibrous fabric sheet is fixed by adhesive penetrated into fibers of the fibrous fabric sheet.

FIG. 1 is an exploded perspective view schematically illustrating a slider body and a fibrous fabric sheet of a slider for a slide fastener according to the embodiment of the present invention, FIG. 2 is a perspective view schematically illustrating the state of the slider for the slide fastener according to the embodiment of the present invention in which the fibrous fabric sheet is bonded to the slider body, FIG. 3 is a rear view of the slider for the slide fastener according to the embodiment of the present invention, for illustrating the back surface of the slider, FIG. 4 is a cross-sectional view taken along line A-A in FIG. 3, and FIG. 5 is a partially expanded cross-sectional view schematically illustrating the state in which the fibrous fabric sheet is fixed by adhesive penetrated into fibers of the fibrous fabric sheet.

The upward direction in FIG. 3 refers to the forward direction of the slider (slider body), the downward direction in FIG. 3 refers to a rearward direction of the slider (slider body), the left side in FIG. 3 refers to the left side of the slider (slider body), and the right side in FIG. 3 refers to the right side of the slider (slider body).

As shown in FIG. 1, the slider for a slide fastener according to the embodiment of the present invention includes the slider body 1 and a pull-tab (not shown). As shown in FIG. 1, FIG. 2 and FIG. 4, the slider body 1 includes an upper blade 2, a lower blade 3 and a connecting post 7 which connects the front end portions of the upper and lower blades 2 and 3 to each other. Right and left upper and lower flanges 6 are respectively arranged on the right and left side portions of the upper and lower blades 2 and 3. In addition, an element guide path is formed between the upper and lower blades 2 and 3 in the slider body 2.

Herein, a pull-tab attachment side of the slider body 1 is referred to as the front side and a side opposite to the front side of the slider body 1 is referred to as the back side unless otherwise specified. In addition, the front surface of the slider body 1 is a surface of the upper blade 2 at the front side (also referred to as the front surface of the upper blade 2), and the back surface of the slider body 1 is a surface of the lower blade 3 at the back side (also referred to as the back surface of the lower blade 3).

As shown in FIG. 1, in the slider body 1, the fibrous fabric sheet 10 is fixed to the back surface of the lower blade 3 by means of an adhesive layer 8. The fibrous fabric sheet 10 can be made of nonwoven fabric, woven fabric, fabric formed by knitting fibers, or the like. The fibrous fabric sheet provided in this manner can impart the function of preventing cold feeling to the slider.

In addition, the adhesive layer 8 may be formed by applying a liquid adhesive or may be made of a sheet-shaped adhesive. However, the sheet-shaped adhesive does not obstruct the function of reducing cold feeling since a little amount of adhesive components leaks and there is neither leakage from the circumference of the fibrous fabric sheet 10 nor exuding from the surface of the fibrous fabric sheet 10, as will be described later. Although the adhesive is not specifically limited as long as it can bond the fibrous fabric sheet 10 to the slider body 1, an epoxy-based adhesive is preferably employed as the adhesive due to its strong bonding force and durability since the slider according to the embodiment of the present invention is often used in cold regions. Although the sheet-shaped adhesive may one, both surfaces of which are sticky, a multilayer structure in which several layers of sheet-shaped adhesives are stacked one on another may be employed.

When the fibrous fabric sheet 10 is attached to the slider body 1, the fibrous fabric sheet 10 and the slider body 1 are bonded together using an adhesive layer 8 interposed therebetween such that one surface of the fibrous fabric sheet 10 faces the back surface of the lower blade of the slider body. Referring to the slider to which the fibrous fabric sheet 10 is bonded to the back surface of the slider, as shown in FIG. 2 and FIG. 3, a circumferential portion 11 on the back surface of the lower blade 3 is exposed without being covered with the fibrous fabric sheet 10. That is, the fibrous fabric sheet 10 is not present on the circumferential portion 11. In addition, the fibrous fabric sheet 10 is arranged such that the fibrous fabric sheet 10 does not protrude toward the outside of the slider body beyond the adhesive layer 8. In this case, since there is little possibility that the fibrous fabric sheet 10 be subjected to peeling force of stripping off the fibrous fabric sheet 10 from slider body 10, the fibrous fabric sheet 10 can be strongly bonded to the slider body 1, thereby ensuring the durability of the slider with the function of reducing cold feeling.

In addition, as shown in FIG. 4, the back surface of the lower blade 3 includes a chamfered portion 12 at the circumferential portion 11 thereof, the chamfered portion 12 being curved so as to come close to the upper blade 2 toward the outside of the slider body 1, and a flat surface 13 surrounded by the chamfered portion 12. The fibrous fabric sheet 10 is fixed to the flat surface 13. According to this configuration, the fibrous fabric sheet 10 can be configured so as not be present on the circumferential portion 11 since the fibrous fabric sheet 10 is arranged on the flat surface 13 surrounded by the chamfered portion 12.

In the meantime, all the portions surrounded by the chamfered portion 12 are not required to be formed as the flat surface. In the portions surrounded by the chamfered portion 12, at least a portion adjacent to the chamfered portion 12 is preferably formed as the flat surface. For example, concaves and convexes may be formed on the central portion of the back surface of the lower blade 3.

In the embodiment shown in FIG. 5, the fibrous fabric sheet 10 is bonded to the flat surface 13 at a certain distance from the boundary of the flat surface 13. This configuration can further prevent the fibrous fabric sheet 10 from being subjected to the peeling force with which the fibrous fabric sheet 10 is stripped off from the slide body 1.

In addition, since the chamfered portion 12 is formed on the circumferential portion 11, a corner of the lower blade does not easily touch the neck or the like. It is possible to prevent cold feeling that would otherwise be caused when the metal slider touches the skin.

Furthermore, in order to ensure that the fibrous fabric sheet 10 is strongly fixed by the adhesive, as shown in FIG. 5, the bonding structure is configured such that the adhesive penetrates between the fibers of the fibrous fabric sheet 10 from a first surface of the fibrous fabric sheet 10, which faces the adhesive layer 8, thereby fixing the fibrous fabric sheet 10. With this bonding structure, since some of the fibers exposed on the first surface of the fibrous fabric sheet 10, which faces the adhesive layer 8 are buried in the adhesive, it is possible to strongly bond the fibrous fabric sheet 10 and the slider body 1 to each other.

In addition, although the adhesive penetrates between the fibers of the fibrous fabric sheet 10, the adhesive does not exude from a second surface of the fibrous fabric sheet 10, which is opposite to the first surface of the fibrous fabric sheet 10, which faces the adhesive layer 8 in order not to have an adverse effect on the feeling of the skin.

In order to effectively prevent the fibrous fabric sheet 10 from exuding from the second surface, which is opposite to the first surface, the adhesive is preferably implemented as a sheet-shaped adhesive. Since the sheet-shaped adhesive has significantly smaller liquidity and higher viscosity than the liquid adhesive, the sheet-shaped adhesive rarely leaks from the circumference of the fibrous fabric sheet 10 or exudes from the second surface of the fibrous fabric sheet 10, which is opposite to the first surface.

As described above, the embodiment of the present invention is configured as follows.

The slider for a slide fastener according to the embodiment of the present invention comprises the slider body 1 which includes the upper blade 2 disposed on the front side of the slider body 1, which is the pull-tab attachment side, the lower blade 3 disposed on the back side of the slider body 1, which is opposite to the front side, and the connecting post 7 connecting the upper blade 2 and the lower blade 3 to each other. The fibrous fabric sheet 10 is integrally fixed to the back surface of the lower blade 3 at the back side, with the adhesive layer 8 being interposed between the fibrous fabric sheet 10 and the lower blade 3.

According to this configuration, it is possible to impart the function of preventing cold feeling to existing sliders at a low cost without adapting the slider body 1 to a special shape.

In addition, since a member for preventing cold feeling is the fibrous fabric sheet 10, the member does not become cold even after the elapse of a long time. Therefore, when the member partially touches the skin of the neck or the like, the member rarely gives cold feeling.

Furthermore, since the fibrous fabric sheet 10 is a sheet-shaped article, the fibrous fabric sheet 10 is not easily released from the slider body 1, thereby obtaining high durability.

According to the embodiment of the present invention as described above, the circumferential portion 11 of the back surface of the lower blade 3 is preferably exposed without being covered with the fibrous fabric sheet 10.

According to this configuration, since the fibrous fabric sheet 10 is not present at least on the circumference of the back surface of the slider body 1, it is possible to reduce the possibility that the fibrous fabric sheet 10 may be stripped off from the end portion thereof, thereby improving the durability of the slider with the function of preventing cold feeling.

According to the embodiment of the present invention, the back surface of the lower blade 3 preferably has the chamfered portion 12 at the circumferential portion 11 thereof, the chamfered portion 12 being curved or inclined so as to come close to the upper blade 2 toward the outside of the slider body 1, and the flat surface 13 surrounded by the chamfered portion 12. The fibrous fabric sheet 10 is preferably fixed to the flat surface 13.

According to this configuration, since the circumferential edge portion of the fibrous fabric sheet 10 does not extend outward beyond the circumference of the back surface of the lower blade 3, it is possible to reduce the possibility that the fibrous fabric sheet 10 may be stripped off from the end portion thereof, thereby improving the durability of the slider with the function of preventing cold feeling.

In addition, since the circumferential portion 11 of the back surface of the lower blade 3 is chamfered such that the circumferential portion 11 is curved or inclined toward the upper blade, the circumferential portion 11 of the lower blade 3 rarely touches the neck or the like. This consequently lowers the possibility that the circumferential portion 11 may touch the skin and give cold feeling to the skin.

According to the embodiment of the present invention as described above, preferably, the fibrous fabric sheet 10 does not protrude toward the outside of the slider body 1 beyond the adhesive layer 8.

This configuration can prevent the fibrous fabric sheet 10 from being stripped off from the end portion while strongly bonding the fibrous fabric sheet 10 to the slider body 1.

According to the embodiment of the present invention as described above, the adhesive layer 8 is preferably formed of an adhesive or an adhesive sheet, and the adhesive is an epoxy-based adhesive.

According to this configuration, since the epoxy-based adhesive has strong bonding force and can withstand low temperature, the fibrous fabric sheet 10 and the slider body 1 can be strongly bonded to each other.

According to the embodiment of the present invention as described above, the adhesive preferably fixes the fibrous fabric sheet 10 through penetration between the fibers of the fibrous fabric sheet 10 from the first surface of the fibrous fabric sheet 10, which faces the adhesive layer 8.

According to this configuration, since some of the fibers exposed on the first surface of the fibrous fabric sheet 10 that faces the adhesive layer 8 are buried in the adhesive, the fibrous fabric sheet 10 and the slider body 1 can be strongly bonded to each other.

According to the embodiment of the present invention as described above, preferably, the adhesive does not exude from the second surface of the fibrous fabric sheet 10, which is opposite to the first surface of the fibrous fabric sheet 10, that faces the adhesive layer 8.

According to this configuration, since the adhesive is not exposed on the side of the fibrous fabric sheet 10, that may touch the skin, when a user is wearing a jacket to which the slider according to the embodiment of the present invention is applied, the adhesive does not touch the skin of the neck or the like while the slider touches the neck or the like. It is therefore possible to maintain high cold feeling prevention effect without decreasing soft feeling while strongly bonding the fibrous fabric sheet 10 and the slider body 1 to each other.

Although the present invention has been described in relation to one exemplary embodiment, a variety of changes can be made without departing from the concept of the present invention.

For instance, although the present invention was illustrated as being applied to the metal slider by way of example, the present invention can be applied to a resin slider.

What is claimed is:

1. A slider for a slide fastener, comprising a slider body which includes:

an upper blade disposed at a front side of the slider body, which is a pull-tab attachment side;

a lower blade disposed at a back side of the slider body, which is opposite to the front side; and a connecting post connecting the upper blade and the lower blade to each other, wherein a fibrous fabric sheet is integrally fixed to a back surface of the lower blade at the back side, with an adhesive layer being interposed between the fibrous fabric sheet and the back surface of the lower blade, and wherein a circumferential portion of the back surface of the lower blade is exposed without being covered with the fibrous fabric sheet.

2. The slider according to claim 1, wherein the back surface of the lower blade comprises a chamfered portion at a circumferential portion thereof, the chamfered portion being curved or inclined so as to come close to the upper blade toward the outside of the slider body, and a flat surface surrounded by the chamfered portion, and the fibrous fabric sheet is fixed to the flat surface.

3. The slider according to claim 1, wherein the fibrous fabric sheet does not protrude toward the outside of the slider body beyond the adhesive layer.

4. The slider according to claim 1, wherein the adhesive layer is formed of an adhesive or an adhesive sheet, and the adhesive is an epoxy-based adhesive.

5. The slider according to claim 4, wherein the adhesive fixes the fibrous fabric sheet by penetrating between fibers of the fibrous fabric sheet from a first surface of the fibrous fabric sheet, which faces the adhesive layer.

6. The slider according to claim 5, wherein the adhesive does not exude from a second surface of the fibrous fabric sheet, which is opposite to the first surface of the fibrous fabric sheet, which faces the adhesive layer.

7. A slider for a slide fastener, comprising a slider body which includes:

an upper blade disposed at a front side of the slider body, which is a pull-tab attachment side;

a lower blade disposed at a back side of the slider body, which is opposite to the front side; and a connecting post connecting the upper blade and the lower blade to each other, wherein a fibrous fabric sheet is integrally fixed to a back surface of the lower blade at the back side, with an adhesive layer being interposed between the fibrous fabric sheet and the back surface of the lower blade, wherein the adhesive layer is formed of an adhesive or an adhesive sheet, and the adhesive is an epoxy-based adhesive, and wherein the adhesive fixes the fibrous fabric sheet by penetrating between fibers of the fibrous fabric sheet from a first surface of the fibrous fabric sheet, which faces the adhesive layer.

8. The slider according to claim 7, wherein the adhesive does not exude from a second surface of the fibrous fabric sheet, which is opposite to the first surface of the fibrous fabric sheet, which faces the adhesive layer.

* * * * *